United States Patent [19]

Liao

[11] Patent Number: 4,939,422

[45] Date of Patent: Jul. 3, 1990

[54] ELECTRONIC BALLAST FOR TUNGSTEN LAMP TUBES

[76] Inventor: Mao J. Liao, 8-1, Jsun Shih Rd., Wei Jsuo Hamlet, Hsi Chou Village, Chang Hua Country, Taiwan

[21] Appl. No.: 262,344

[22] Filed: Oct. 25, 1988

[51] Int. Cl.[5] ..... H05B 41/14

[52] U.S. Cl. ..... 315/101; 315/DIG. 7

[58] Field of Search ..... 315/101, 200 R, DIG. 5, 315/DIG. 7

[56] References Cited

U.S. PATENT DOCUMENTS 3,700,956 10/1972 Cluett ..... 315/101

*Primary Examiner*—Robert J. Pascal

*Attorney, Agent, or Firm*—Bacon & Thomas

[57] ABSTRACT

An electronic ballast for tungsten lamp tubes is operable even when one of the tungsten lamp filaments is broken or missing. The transformer negative feedback oscillator which drives the tungsten filaments includes parallel connection to one of the filaments through a resistor of one of the filaments and parallel connection to the other filament through a tuning circuit to make the circuit operable when one of the filaments is broken or missing. The tuning circuit, in addition to providing a closed circuit when one of the tungsten filaments is missing, also enables the intensity of the light to be adjusted.

4 Claims, 1 Drawing Sheet

ELECTRONIC BALLAST FOR TUNGSTEN LAMP TUBES

BACKGROUND OF THE INVENTION

The present invention relates to an all-purpose AC ballast applicable for use in tungsten filament lamp tubes. The ballast is capable of instantaneously turning on the lamp tube even if the tungsten of the lamp tube is severed, and is also capable of adjustment for light intensity.

Conventional ballasts for fluorescent lamps normally include a binary alloy and neon or argon gases. Cold cathode discharge is accomplished by heating the binary alloy to cause a stabilizer to produce high voltage to turn on the tube. In recent years, the alternative technology of using DC powered ballasts to produce high frequency oscillating voltages has become prevelant.

However, while enabling instantaneous starts, electronic ballasts provide little improvement in the durability of the lamp tube. Using this technology, when the tungsten filament is cut-off, the lamp becomes inoperable. Also, such starters do not provide optimum energy efficiency and are therefore relatively expensive to operate. Finally, presently used fluorescent lamps do not permit adjustment of current or light intensity.

Such disadvantages cause consumers to install neon or electric lamps rather than fluorescent lamps for such purposes as advertising illumination because of the long-term and heavy expenditure on electricity resulting from inefficient ballasts.

The present invention overcomes these drawbacks and problems by providing an all-purpose electronic ballast which elicits better performance from tungsten lamp tubes, even when one of the tungsten filaments is missing or broken.

SUMMARY OF THE INVENTION

The main object of the present invention is to provide an electronic ballast applicable for tungsten lamp tubes and also to tungsten lamp tubes in which a tungsten filament is cut-off or missing, and which includes a full-wave bridge rectifier, a transistor, and a variable winding as well as various diodes, condensers, and resistors.

A positive bias at the base of the transistor increases the current between the collector and the emittor of the transistor, and by matching the phase characteristic of the primary winding of the high frequency transformer to obtain negative feedback and to let the collector and the emitter cut off the conduction therebetween so as to repeatedly cause oscillation in the transformer negative feedback circuit, the voltage at both ends of the secondary winding of the high frequency transformer is increased to cause an oscillating high voltage which illuminates the lamp tube instantaneously. As soon as the lamp tube is lighted, the current is reduced and the voltage drops smoothly and immediately to stabilize the light intensity.

Another object of the present invention is to provide an electronic ballast for tungsten lamp tubes as described above wherein a variable winding is connected to a condensor by a parallel connection and further connected with the secondary winding of the high frequency transformer and to the collector of the transistor to form a light and current regulation circuit for adjustment of lamp tube light intensity.

A still further object of the present invention is to provide an electronic ballast applicable for tungsten lamp tubes as described above wherein one end of the primary winding and one end of the secondary winding of the high frequency transformer is connected with a resistor by means of a parallel connection to enable the ballast to operate even when the tungsten is missing or broken.

The above-described objects and other objects of the invention will be become more apparent from the following description of a preferred embodiment of the invention.

DETAILED DESCRIPTION OF THE PREFERRED EMBODIMENT

Figure 1:
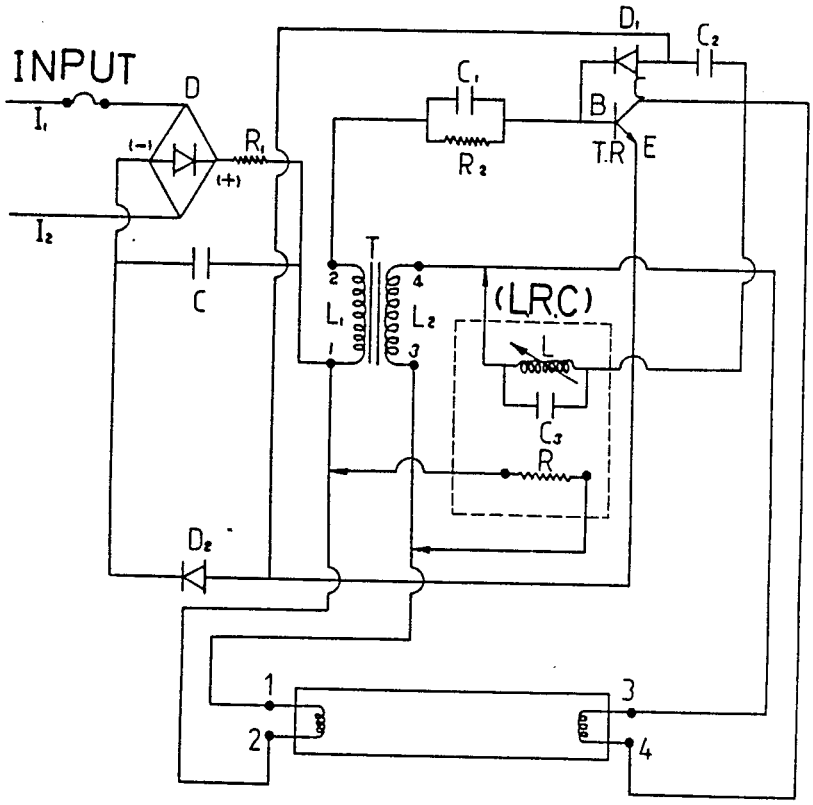
FIG. 1 is a detailed circuit diagram of a ballast according to a preferred embodiment of the invention.

Referring to FIG. 1, the electronic ballast applicable for tungsten lamp tubes and for lamp tubes having a broken or missing tungsten filament includes a full-wave bridge rectifier D arranged at the back of the AC power input terminal 11 and 12 to rectify AC power into DC power. Rectifier D is further connected to a resistor R1 and a condenser C connected together in parallel, the current from the rectifier being transformed into an oscillating wave form upon application of power to the circuit.

One input of a high frequency transformer T is connected to resistor R1 and condenser C, and includes primary winding L1 and secondary winding L2. Primary winding L1 has two contact points L1-1 and L1-2, and secondary winding L-2 has another two contact points L2-3 and L2-4, contact point L1-1 being directly connected with the paralleled resistor R1 and condenser C and also connected to the contact point of the tube to further pass through a tungsten filament connected between contact points 1 and 2 of the tube. Contact 2 is connected to high frequency transformer T via contact point L2-3 of the secondary winding L2 and contact point L2-4 of the secondary winding to connect the contact point 3 of the tube to the contact point 4 via a second tungsten filament.

Transistor TR provides switching for the transformer oscillator feedback circuit as follows: collector C is connected to the contact point 4 of the tube, emitter E is connected through a diode D2 to the full-wave bridge rectifier D, and base B is connected to parallel connected resistor R2 and condenser C1, which are further connected to the contact point L1-2 of the primary winding of the high frequency transformer T for current transmission, feedback from the transformer causing the base of the transistor TR to switch on and off, alternately increasing and decreasing the collector current, resulting in oscillations of increasing amplitude in the secondary winding as will be explained below.

Tuning of the oscillator is made possible by a variable winding L and a condenser C3 arranged together through a parallel connection with each other and with rectifier D, and which are connected to the contact point L2-4 of the secondary winding L2 of the high frequency transformer T and the connector C of the transistor TR so as to provide a current for light intensity regulation and current regulation. This parallel connection also makes possible operation of the circuit even when the tungsten filament between contacts 3 and 4 of the lamp tube are broken or missing.

Operation of the ballast even when the tungsten filament between contacts 1 and 2 of the lamp tube is broken or missing is made possible by a resistor R which is connected with the contact point L1-1 of the primary winding L1 of the high frequency transformer T and the contact point of the secondary winding L2 of the high frequency transformer T through a parallel connection. Diodes D1, D2, and condenser C2 are provided to respectively connect the transistor DR through a parallel connection with rectifier D in order to protect the transistor and prevent abnormal generation of currents in the circuit.

The ballast of the preferred embodiment operates as follows: When AC power (110 V) is connected to the full-wave bridge rectifier D, the power is rectified into DC power and an oscillating wave form (about 30 KHZ–50 KHZ) is provided by means of the power start action through condenser C and resistor R. As a result, base B of the transistor TR produced a positive bias to reinforce the current between the collector C and the emitter E of the transistor TR.

Because of the phase characteristics of the primary winding L1 of the high frequency transformer T, a negative feedback causes collector C and emitter E to cyclically cut off the conduction therebetween so as to repeatedly cause oscillation and to further raise the voltage at both ends of the secondary winding L2 of the high frequency transformer T.

Therefore, the contact points (terminals) 1, 2, 3, and 4 of the lamp tube socket are affected by the oscillating high voltage to be instantaneously initiated to turn on the lamp tube even if either one of the tungsten filaments is broken or missing. When the lamp tube is lighted, the current and voltage are smoothly reduced and dropped as the circuit reaches a steady state condition causing the intensity of the light to be very stable. Further, the light intensity of the lamp tube can be regulated through the regulation of the variable winding L.

The ballast of the preferred embodiment has the following advantages:

1. The ballast of the present invention may be used with any of a large number of fluorescent tubes from different manufacturers.

2. Any brand-new or used tubes or any tubes of which a tungsten filament has been cut-off or is absent may be efficiently lighted through the ballast of the present invention (although the invention does not apply to tubes in which leakage or separation of gases in the tubes has occurred). Therefore, the present invention can extend the service life of lamp tubes.

3. The present invention uses a variable winding to regulate the current so as to provide the user with a preferred light intensity according to his requirements.

4. Fluorescent lamp tubes can be lighted by means of a series connection to replace incandescent lamps or neon lamps for advertising illumination purposes, so as to drastically save electricity expenditure.

5. As soon as the power is turned on, the lamp tube will start to illuminate instantaneously there by saving waiting time.

6. By means of the operation of the present invention, stable and clear intensity of light is achieved to protect the viewers eyes.

7. The invention provides a simple structure, high performance, low voltage and is inexpensive to manufacture.

8. The invention is light, and convenient to install.

Finally, it is to be understood that the above description is not to be construed as limiting, and that the scope of the invention is intended to be defiant solely by the appended claims.

I claim:

1. An electronic ballast for tungsten lamp tubes including first and second contacts arranged to be connected by a first tungsten filament and third and fourth contacts arranged to be connected by a second tungsten filament, comprising:

rectifier means for providing DC power to the ballast;

a resistor and a condenser connected by a parallel connection, said parallel connected resistor and condenser being further connected with said rectifier means to provide an oscillating wave form;

a high frequency transformer comprising a primary winding having first and second contacts and a secondary winding having first and second contacts, said first contact of said primary winding being directly connected to said parallel connected resistor and condenser, to the first contact of the lamp tube, the second contact of the lamp tube being connected to the first contact of the secondary winding which is connected via the second contact of the secondary winding to the third contact of the lamp tube;

a transistor including a collector, emitter, and base, the collector being connected to the fourth contact of the tube, the emitter being connected to the DC supply means, and the base being connected to a second resistor and a second condenser, the second resistor and second condenser being connected in parallel to each other and in series between the base of the transistor and the second contact of the primary winding, whereby said transistor and transformer form a transformer negative feedback circuit; and a third resistor connected between the first contact of the primary winding and the first contact of the secondary winding through a parallel connection which enables the transformer negative feedback circuit to oscillate even when the first tungsten filament is missing or broken.

2. An electronic ballast for tungsten lamp tubes as claimed in claim 1, further comprising a variable winding and a third condenser connected to each other in parallel, the parallel connected variable winding and third condenser being further connected to the second contact of the secondary winding and to the collector of the transistor so as to permit adjustment of light intensity and current and also to emable the transformer negative feedback circuit to oscillate even when the second tungsten filament is missing or broken.

3. An electronic ballast for tungsten lamp tubes as claimed in claim 1, further comprising diodes and a fourth condenser connected between said DC power supply means and said transistor for preventing currents from arising in the circuit unless said rectifier means is providing DC power to the ballast.

4. An electronic ballast for tungsten lamp tubes including first and second contacts arranged to be connected by a first tungsten filament and third and fourth contacts arranged to be connected by a second tungsten filament, comprising:

rectifier means for providing DC power to the ballast;

a resistor and a condenser connected by a parallel connection, said parallel connected resistor and condenser being further connected with said rectifier means to provide an oscillating wave form;

a high frequency transformer comprising a primary winding having first and second contacts and a secondary winding having first and second contacts, said first contact of said primary winding being directly connected to said parallel connected resistor and condenser, to the first contact of the lamp tube, the second contact of the lamp tube being connected to the first contact of the secondary winding which is connected via the second contact of the secondary winding to the third contact of the lamp tube;

a transistor including a collector, emitter, and base, the collector being connected to the fourth contact of the tube, the emitter being connected to the DC supply means, and the base being connected to a second resistor and a second condenser, the second resistor and second condenser being connected in parallel to each other and in series between the base of the transistor and the second contact of the primary winding, whereby said transistor and transformer form a transformer negative feedback circuit; and a variable winding and a third condenser connected to each other in parallel, the parallel connected variable winding and third condenser being further connected to the second contact of the secondary winding and to the collector of the transistor so as to permit adjustment of light intensity and current and also to enable the transformer negative feedback circuit to oscillate even when the second tungsten filament is missing or broken.

* * * * *